United States Patent [19]

Shiba et al.

[11] 3,982,950

[45] Sept. 28, 1976

[54] SILVER HALIDE PHOTOGRAPHIC EMULSION FOR USE IN FLASH EXPOSURE

[75] Inventors: Keisuke Shiba; Haruo Takei; Akira Sato; Akira Ogawa, all of Minami-ashigara, Japan

[73] Assignee: Fuji Photo Film Co., Ltd., Minami-ashigara, Japan

[22] Filed: Feb. 4, 1975

[21] Appl. No.: 546,974

Related U.S. Application Data

[63] Continuation-in-part of Ser. No. 319,810, Dec. 29, 1972, abandoned.

[30] Foreign Application Priority Data

Dec. 28, 1971 Japan ..... 46-3038

[52] U.S. Cl. ..... 96/139; 96/27 E; 96/108

[51] Int. Cl.[2] ..... G03C 1/10

[58] Field of Search ..... 96/139, 27 E, 45.2, 96/108

[56] References Cited

UNITED STATES PATENTS

| | | | |
|---|---|---|---|
| 3,385,707 | 5/1968 | Riester et al. | 96/139 |
| 3,480,439 | 11/1969 | Kampfer et al. | 96/139 |
| 3,672,897 | 6/1972 | Sato et al. | 96/139 |
| 3,703,377 | 11/1972 | Sakazume et al. | 96/139 |
| 3,718,476 | 2/1973 | Fumia et al. | 96/139 |
| 3,790,390 | 2/1974 | Shiba et al. | 96/139 |

*Primary Examiner*—J. Travis Brown
*Attorney, Agent, or Firm*—Sughrue, Rothwell, Mion, Zinn and Macpeak

[57] ABSTRACT

A silver halide photographic emulsion for use in flash exposure, which contains a sensitizing amount of a defined simple merocyanine dye.

4 Claims, 19 Drawing Figures

SILVER HALIDE PHOTOGRAPHIC EMULSION FOR USE IN FLASH EXPOSURE

CROSS-REFERENCE TO RELATED APPLICATIONS

This application is a continuation-in-part application of Ser. No. 319,810, filed Dec. 29, 1972, entitled, "*Silver Halide Photographic Emulsion for Use in Flash Exposure*" for Keisuke Shiba et al, now abandoned.

BACKGROUND OF THE INVENTION

1. Field of the Invention

The present invention relates to a silver halide photographic emulsion sensitized with dyes and, more particularly, it relates to a silver halide photographic emulsion having high sensitivity to "flash exposure" by a blue-green light and having high storage stability under high temperature and high humidity. The term "flash exposure" will be defined hereinafter in this specification.

2. Description of the Prior Art

Recently, new techniques have been developed for rapid communication of information and recording. For example, the press facsimile system for sending newspaper copies to a distant place, high speed photographic typesetting systems for composing type extremely rapidly, cathode ray tube display systems for indicating and recording the output information from a computer as figures or letters using a cathode ray tube, and like systems. The light-sensitive material used in these systems is exposed for a period of less than 1/10,000 second, often as short as about 1/1,000,000 second, by means of an exposing apparatus provided in the above-described systems.

As the light source or exposing apparatus, there are combinations of high illuminance light sources such as a xenon flash, a flying spot of cathode rays traced on a fluorescent tube, (as used in television, facsimile and the like), a laser, a xenon arc light or a high pressure mercury lamp with a high speed shutter, and the like.

The xenon flash light and the arc light have strong energy over a comparatively wide range of wavelengths. In these cases the light of short wave-length is largely absorbed in the optical apparatus in the system used, and hence the light of longer wave length relatively increases in strength.

In the cathode ray tube display, the luminescence from many kinds of fluorescent materials, e.g., P-1, P-11, P-15, P-16, P-22D, P-24, P-31 and P-22 has been utilized. Of these, it is known that the peaks of the spectral energy distribution of the luminescence of P-15, P-24 and P-31 are at about 505 nm, 520 nm and about 520 nm respectively. A silver halide photographic emulsion to be exposed to such blue-green light must be particularly sensitized with dyes.

The term "flash exposure" as is used herein means high-intensity short-time exposure shorter than about 1/1,000 second, preferably shorter than 1/10,000 second, which is appropriate for the above-described purposes.

The sensitization of silver halide photographic emulsions used in light-sensitive materials particularly adapted to flash exposure is influenced not only by the pAg of the emulsion, the halogen composition, grain size and the crystal habit, but also by the conditions of the chemical sensitization or of chemical ripening.

The dye sensitization of the emulsion to flash exposure has so far been said to be dominantly dependent on the light-sensitive characteristics of the silver halide grain itself contained in the emulsion. However, it has also been found that dye sensitization is largely dependent on the chemical structure and the properties of the dye used (see, for example, Japanese patent application Nos. 104009/69; 2819/70; and 12306/70). In addition, the supersensitization thereof to flash exposure is also dependent on the combination of the dye groups used (see, Japanese patent application Nos. 48546/70 and 90950/70). The functional mechanism thereof has not been clarified (see, for example, Japanese patent application No. 1320/71). Therefore, it cannot be concluded that conventional sensitizing dyes can be directly applied to sensitization to flash exposure.

Recently, two or three dyes in combination providing high sensitivity to flash exposure by blue-green light were found. However, most of these dye groups are so unstable under high humidity that when left for about 2 days under a relative humidity of 80% the sensitizing property thereof was reduced to less than ½.

It is convenient for silver halide light-sensitive materials to be capable of being treated under a safe light which is as bright as possible. Light-sensitive materials for flash exposure are desirably treated under an orange-yellow safe light such as No. 2A or No. 2B safe light manufactured by the Fuji Photo Film Co., Ltd. These safe lights absorb light of a wave-length shorter than about 540 nm. Accordingly, sensitizing dyes capable of providing spectral sensitivity distribution where maximum sensitivity lies in the wave-length region shorter than 520 nm and wherein sensitivity in the longer wave-length region is sharply reduced are very useful. However, dyes satisfying such conditions are very few.

SUMMARY OF THE INVENTION

The primary object of the present invention is to provide a silver halide light-sensitive material which retains its sensitivity to flash exposure and its gamma even when stored under conditions of high temperature and high humidity.

Another object of the invention is to provide a silver halide material having high sensitivity to flash exposure by blue-green light of a wave-length shorter than about 520 nm and having high safty under a safe light.

These and other objects of the invention will become clearer from the following description.

The objects of the present invention are attained by incorporating in a silver halide emulsion a merocyanine dye in a sensitizing amount, preferably, $10^{-5}$ – $10^{-2}$ mol per 1 mol of silver halide of the formula,

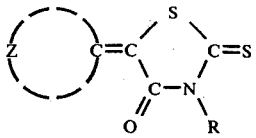

as described hereinbelow.

DETAILED DESCRIPTION OF THE INVENTION

Figure 2:
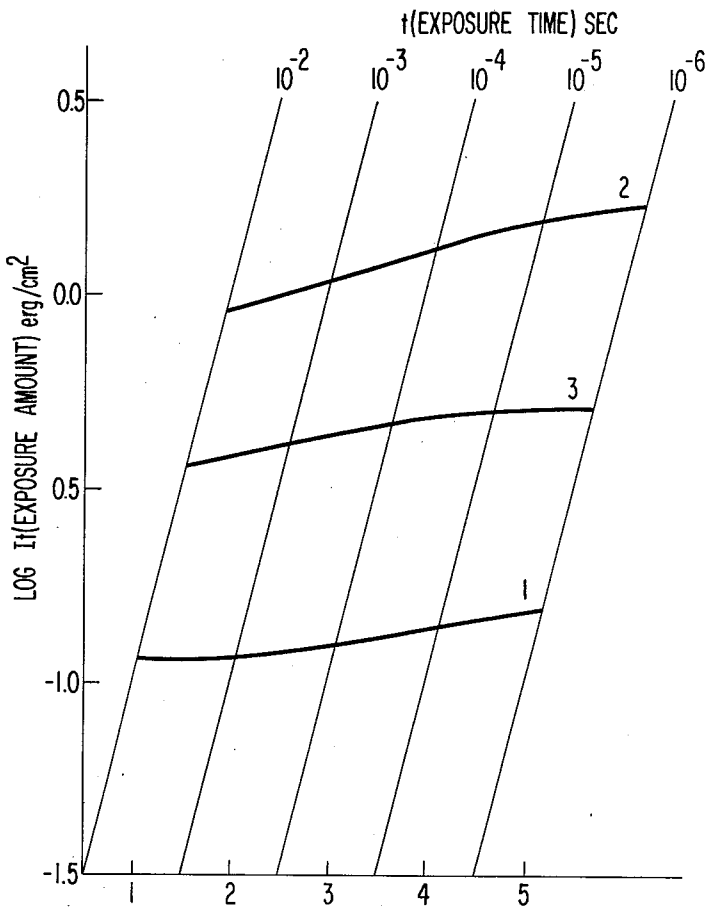
FIGS. 1 – 6 show reciprocity law curves in order to illustrate one of the characteristics of the silver halide photographic light-sensitive material of the present invention, wherein log.It (relative exposure energy in erg/cm$^2$) is plotted as the ordinate and logI (relative exposure strength in erg/cm$^2$.sec.) as the abscissa.

As specific examples of sensitizing dyes used in the invention, there are those represented by the following general formula (I):

General formula (I)

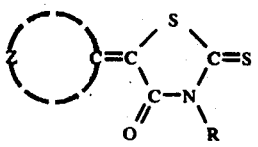

wherein R represents a saturated or unsaturated aliphatic hydrocarbon group or aryl group, Z represents the atoms necessary to form a cyanine hetero ring nucleus selected from the group consisting of a 4-pyridine nucleus, a-benzothiazole nucleus and a benzimidazole nucleus.

Of dyes represented by the general formula (I), it is preferred to employ a dye represented by the following general formula (II):

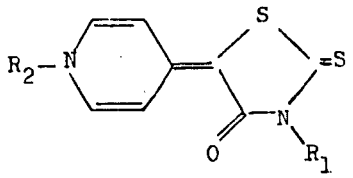

(II)

wherein $R_1$ and $R_2$ each represent an unsubstituted alkyl group, an allyl group, a sulphoalkyl group, or a carboxyalkyl group.

The simple merocyanine dyes as are used in the present invention have long been known (see, for example, "The Cyanine Dyes and Related Compounds" written by F. M. Hamer and published by Inter Science publishers in 1964, at pages 511 – 611).

In recent years, research efforts regarding the simple merocyanine dyes led to the discovery of the photographic effect of many specific substituents, the combined use thereof with couplers incorporated in the photographic emulsion layer and the discovery of the supersensitizing action thereof. For example, see Japanese Pat. Nos. 15735/69 and 3644/69; German Pat. OLS Nos. 1,934,891; 1,917,163 and 2,001,572; U.S. Pat. Nos. 2,493,748; 3,385,707 and 3,545,975; Japanese Pat. Nos. 19034/70 and 30023/71; German Pat. OLS No. 2,101,071; U.S. Pat. Nos. 2,977,299 and 2,972,539; and German Pat. Nos. 918,309 and 1,472,877; etc.

In general formula I,R preferably represents alkyl groups having an alkyl moiety of up to 8 carbon atoms e.g., a methyl group, ethyl group, n-butyl group, isoamyl group, a cyclohexyl group, a hydroxyalkyl group (e.g., hydroxyethyl group, etc.), a cyanoalkyl group (e.g., cyanoethyl group, etc.) an aminoalkyl group (e.g., morpholinoethyl group, dimethylaminoethyl group, etc.), an allyl group, an aralkyl group (e.g., benzyl group, p-sulfobenzyl group, etc.) a sulfoalkyl group (e.g., sulfopropyl group etc.), a carboxyalkyl group (e.g., carboxymethyl group, carboxyethyl group, etc.), an acylalkyl group (e.g., acetoxyethyl group, etc.), an aryl group (e.g., phenyl group, p-sulfophenyl group, p-tolyl group, p-chlorophenyl group, etc.), and the like.

As the cyanine hetero ring nucleus completed by Z, there are illustrated, for example, nuclei such as a 4-pyridine nucleus, benzothiazole nucleus, or benzimidazole nucleus, wherein the N-substituent thereof is preferably an alkyl group such as an unsubstituted alkyl group or substituted alkyl group, containing up to eight carbon atoms in the alkyl moiety, (e.g., sulfoalkyl, carboxyalkyl, allyl, etc.). In addition, the hetero ring nucleus may be substituted by a lower alkyl group preferably having up to 4 carbon atoms, halogen atom, an alkoxycarbonyl group, a cyano group, a trifluoromethyl group, an alkoxy group, a hydroxy group, an aryloxy group such as a phenoxy or substituted phenoxy group, an alkylcarbonyl group, an acetoxy group, an acyl group, an alkylsulfonyl group or a phenyl group where the alkyl moiety has up to 4 carbon atoms.

Typical cyanine hetero ring nuclei include, for example a 1-ethyl-4-pyridine nucleus, 1-allyl-4-pyridine nucleus, 1-(3′-sulfobutyl)-4-pyridine nucleus, 1-(carboxyethyl)-4-pyridine nucleus, 3-(3-sulfopropyl)benzothiazole nucleus, and the like.

Typical examples of the dyes used in the invention are illustrated below, but the invention is not limited thereto.

(IA)

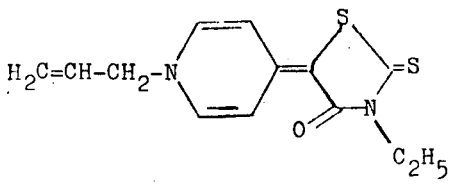

(IB)

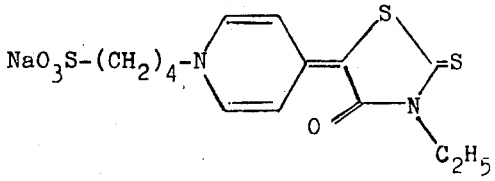

(IJ)
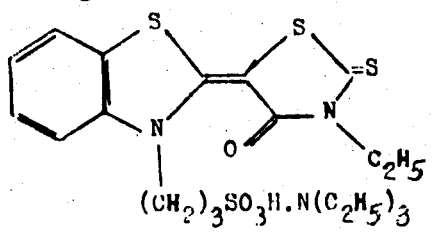
(IK)
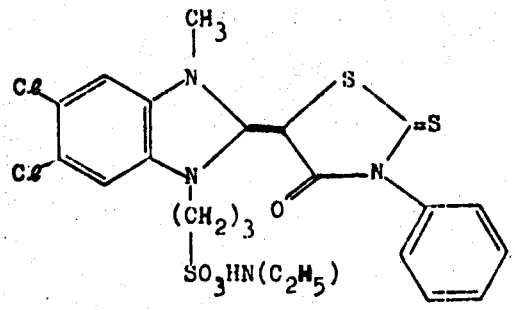
(IL)
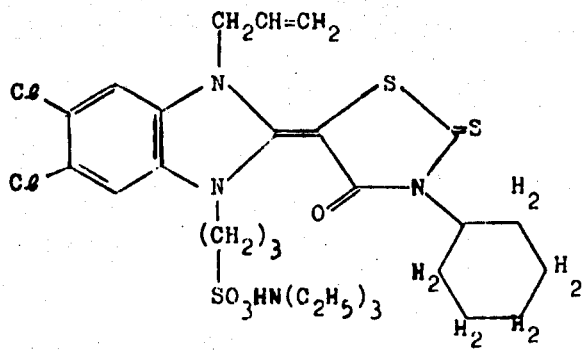
Comparative dyes discussed at a later part of the specification.
(A)
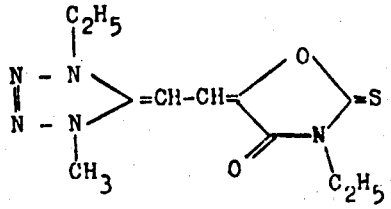
(B)
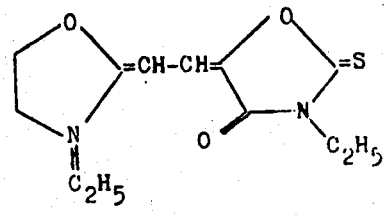
(C)
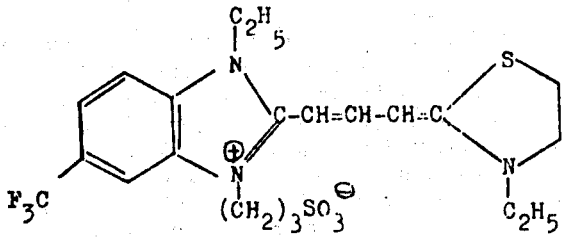

(D)

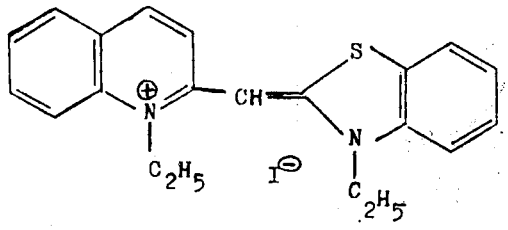

(E)

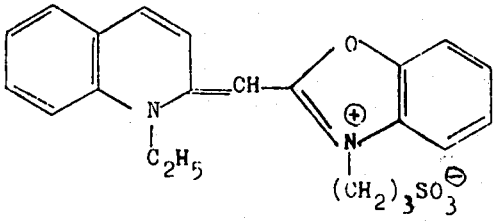

(F)

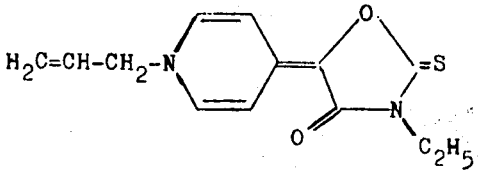

(G)

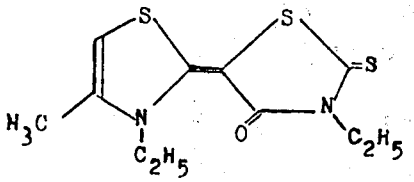

(H)

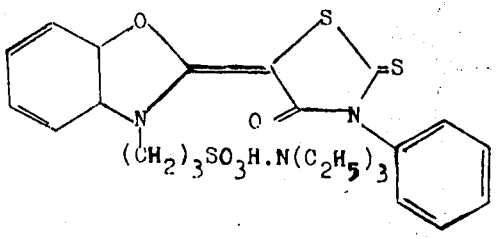

The above comparative dyes will be used to comparatively show the characteristics of the present invention. Dyes (A) and (B) are described in Japanese patent application Nos. 104009/69 and 12306/70, respectively. Dyes (C), (D) and (E) are cyanine dyes and exhibit a sensitizing property in normal silver halide emulsions in the wave-length region of blue-green light. It will be seen from the description below how the sensitizing dyes of the present invention are excellent as compared with those comparative dyes.

The silver halide emulsion grains to be used in the invention may be any silver halide emulsion of silver chlorobromide, silver chlorobromoiodide, silver bromide, silver bromoiodide and the like. It is preferred that the grain size range from about 0.04 to about 1 micron. Particularly, the mode (the most frequent) size of the grain is preferably less than 0.8 micron. The determination of "mean-grain size" or "mode size" is, for example, described in "Photographic Journal" 79, PP. 330–380 (1939) and ibid. 62, PP. 407-410 (1922) by Trivelli et al.

In the following examples, a silver bromoiodide emulsion and a silver chlorobromide emulsion are illustrated as the typical examples from the emulsions.

It is preferred silver halides used in the invention are subjected to reduction sensitization or noble metal sensitization in addition to sulfur sensitization. Furthermore, in some cases, Group VIII metal salts or group II metal salts in the Periodic Table are added thereto upon the formation of the precipitate of silver halide grains or during the physical ripening or chemical ripening (sensitization). These compounds can provide photographic effects such as high contrast in gradation, stabilization and anti-fogging in addition to sensitization. Illustrative of such metal salts are iron(II) sulfate, potassium hexacyanoferrate(II) ($K_4Fe(CN)_6.3H_2O$), potassium hexacyanoferrate(III) ($K_3Fe(CN)_6$), cobalt chloride, cobalt nitrate, potassium hexacyanocobaltate(III) ($K_3Co(CN)_6$), nickel(II) chloride, ruthenium(III) chloride, potassium hexachlororuthenate(IV) ($K_2RuCl_6$), rhodium(III) chloride ($RhCl_3.4H_2O$), ammonium hexachlororhodate(III) ($(NH_4)_3RhCl_6$), palladium(II) chloride, palladium(II) bromide ($PdBr_2$), potassium hexachloropalladate(IV) ($K_2PdCl_6$), potassium tetrathiocyanopalladate(II) ($K_2Pd(CNS)_4$), osmium(II) chloride, iridium(III) chloride, iridium(IV) chloride, iridium(III) bromide ($IrBr_3.4H_2O$), potassium hexachloroiridate(III) ($K_3IrCl_6$), potassium hexachloroiridate(IV) ($K_2IrCl_6$), ammonium hexachloroplatinate(IV) ($(NH_4)_2PtCl_6$), potassium hexachlorophlatinate(IV) ($K_2PtCl_6$), zinc chloride, cadmium chloride, strontium chloride and the like.

These metal salts are used singly or as combinations thereof, usually in an amount of from $10^{-6}$ mol to $10^{-3}$ mol per 1 mol of silver halide.

It is preferred to use a gold salt and at least one of the group VIII metal salts in combination or a gold salt and at least one of the group II metal salts in combination. The molar ratio of the gold salt to the group VIII metal salt can be in a range of from about 10 : 1 to about 1 : 1000, and the molar ratio of the gold salt to the group II metal salt can be in a range of from about 1 : 1 to about 1 : 1000.

The silver halide emulsion used in the invention can be used in combination with supersensitizing agents, stabilizing agents, antifoggants, development accelerators, color couplers, photographic dyestuff, hardeners, surface active agents, etc., in addition to the sensitizing dye.

As the protective colloid, not only gelatin or gelatin derivatives such as gelatin phthalate, gelatin malonate and gelatin succinate, but also mixtures thereof with generally used water-soluble natural or synthetic polymers (e.g., cellulose, cellulose derivatives such as hydroxyethyl cellulose and carboxymethyl cellulose, polyvinyl alcohol, polyvinyl pyrrolidone, polyacrylamide, polystyrene sulphonate etc.) may be used. It is preferred that the protective colloid employed is in a range of 20 – 500 g per mole of Ag. Furthermore, in order to improve the dimensional stability of the light-sensitive material, a plasticizer (such as a phosphate, phthalate or like material), polymer latex (e.g., acrylate series) or a matting agent may also be used in combination therewith.

The emulsion completed by adding these additives is applied to a suitable support, e.g., cellulose triacetate, polyethylene terephthalate or a like plastic film, a glass plate, baryta paper, resin-coated paper, synthetic paper, etc.

In order to improve the sharpness of the image, a dyed sublayer or antihalation layer or a filter layer may be provided or a photographic dyestuff may be incorporated in an emulsion of the present invention.

The sensitizing dye used in the invention is added as a solution in water, methanol, pyridine, acetone or a Cellosolve derivative. The sensitizing amount of the dye added is preferably from about $10^{-4}$ mole to about $10^{-2}$ mol per 1 mol of silver halide. The suitable amount of the sensitizing dye tends to increase in the case of flash exposure as compared with that in the commonly practiced exposures and, in some cases, the amount of the dye in flash exposure reaches 10 times that in the common exposures The first characteristic of the present invention lies in that the maximum sensitivity wavelength is in the region shorter than at most 520 nm, and that high sensitivity is provided to flash exposure.

The second characteristic of the invention lies in that high stability is provided even when an element containing the dyes of this invention is stored under high temperature and high humidity conditions.

Although a few sensitizing dyes are known having the first characteristic(other than the dyes used in the invention), all of such dye are too unstable, particularly against humidity, to be practical. This is basically due to the fact that such dyes providing light absorption selectively in the short wavelength region are chemically unstable.

On the other hand, the sensitizing dyes of the present invention are selected from the simple merocyanine dyes which provide high sensitivity and have high stability against high temperature and high humidity. Of these, the dyes comprising a rhodanine nucleus and a 4-pyridine nucleus improve the poor storage property of the original silver halide emulsion as well, and thus provide extremely excellent stability. This can be said to be a surprising fact.

The third characteristic of the invention is that reciprocity law failure at high intensity can be improved. Known sensitizing dyes having the first characteristic show a small reciprocity law failure at high intensity in the wavelength region of the spectral sensitization, whereas the dyes in accordance with the present invention improve the reciprocity law failure at high intensity of the original emulsion in the wave-length region of the intrinsic sensitivity of the silver halide, which can be said to be a surprising fact.

The fourth characteristic of the invention is that the dyes of the invention provide a spectral sensitivity distribution having a sharp cut on the longer wave-length side and good stability under a safe light, which will be understood by reference to the accompanying spectrograms.

The above-described characteristics will be more clearly understood from the following examples. All percentages, unless otherwise indicated, are by weight

EXAMPLE 1

A gelatino silver chlorobromide emulsion was obtained by the standard double jet method. The halogen composition of the grains was 85 mol% $Br^-$ ion. 1.5 cc of a 1/100,000 (by weight) solution of rhodium (III) chloride and 4.3 cc of a 1/10,000,000 (by weight) solution of mercuric rhodamide per 1 milimol of silver ion were incorporated in the emulsion during the step of precipitate formation. The silver chlorobromide emulsion thus obtained was gold-sensitized using 2.7 cc of a 10% solution of gold(III) chloride per 1 mol of silver ion and was at the same time sulfur-sensitized by sodium thiosulphate in a conventional manner. The mode size of the grains was 0.7 micron. The emulsion thus obtained contained about 1.2 mol of silver ion per 1 Kg of the emulsion.

300 Grams of water was added to 700 g of the resulting silver chlorobromide raw emulsion to make 1 Kg. This was melted at 50°C and stored at 40°C, and a methanol solution containing $5 \times 10^{-3}$ mols per ml. of each of the sensitizing dyes listed in Table 1 was added thereto with stirring. Furthermore, 20 cc of a 2% aqueous solution of 2,4-dichloro-6-hydroxy-S-triazine and 10 cc of a 1% aqueous solution of sodium nonylbenzenesulfonate were added thereto and the emulsion then applied to a cellulose triacetate film in a dry thickness of about 4 microns.

The resulting samples were cut into strips, and subjected to sensitometry. The sensitometer used was a flash sensitometer (made by E. G. G. Co.) wherein the light-emission period had previously been set to the time (in seconds) given in Table 1. A monochromatic light was obtained using an interference filter. The exposure amount of the light was determined by conducting physical photometry and photographic photometry using an actinometer.

The exposed strips were developed at 20°C for 3 minutes using the following developer, then fixed, washed and dried in a conventional manner. The photographic density of the strips thus processed was measured by means of a standard-type densitometer made by Fuji Photo Film Co., Ltd. to determine the photographic characteristic curves.

The exposure amount necessary to provide a density of (fog + 1.0) in optical density was determined, and the sensitizing effect of the dyes was indicated by the reciprocal of the exposure amount (which is defined as the relative sensitivity).

Composition of the developer used:

| | | |
|---|---|---|
| Water | 500 | ml |
| Metol | 2 | g |
| Anhydrous sodium sulfite | 90 | g |
| Hydroquinone | 8 | g |
| Sodium carbonate monohydrate | 52.5 | g |
| Potassium bromide | 5 | g |

-continued

| | | |
|---|---|---|
| Water to make | 1000 | ml |

The results obtained are shown in Table 1.

Table 1

Figure 1:
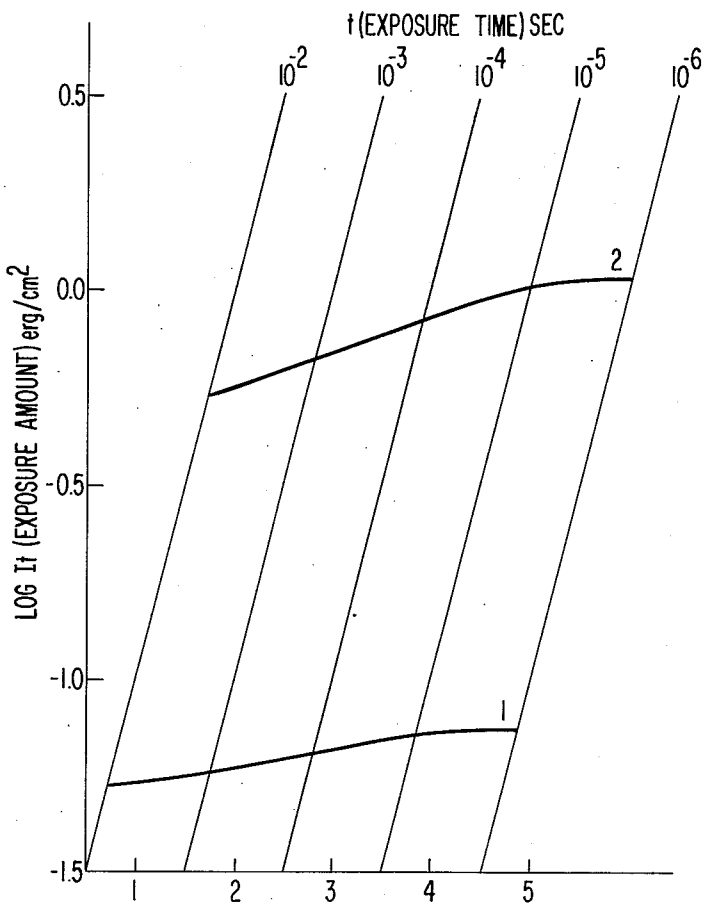
Figure 4:
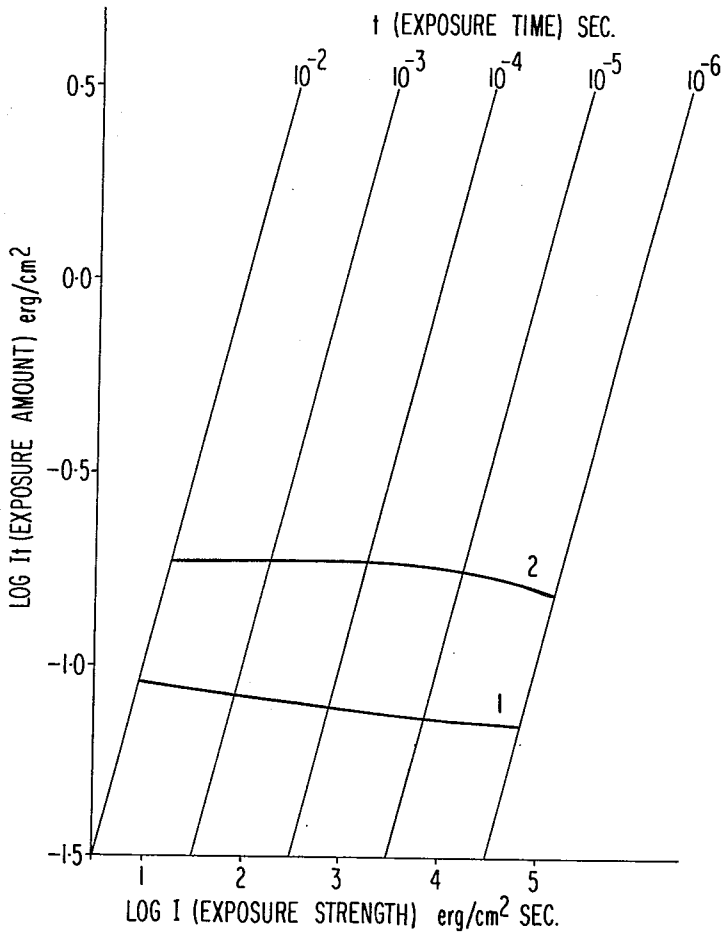
Figure 3:
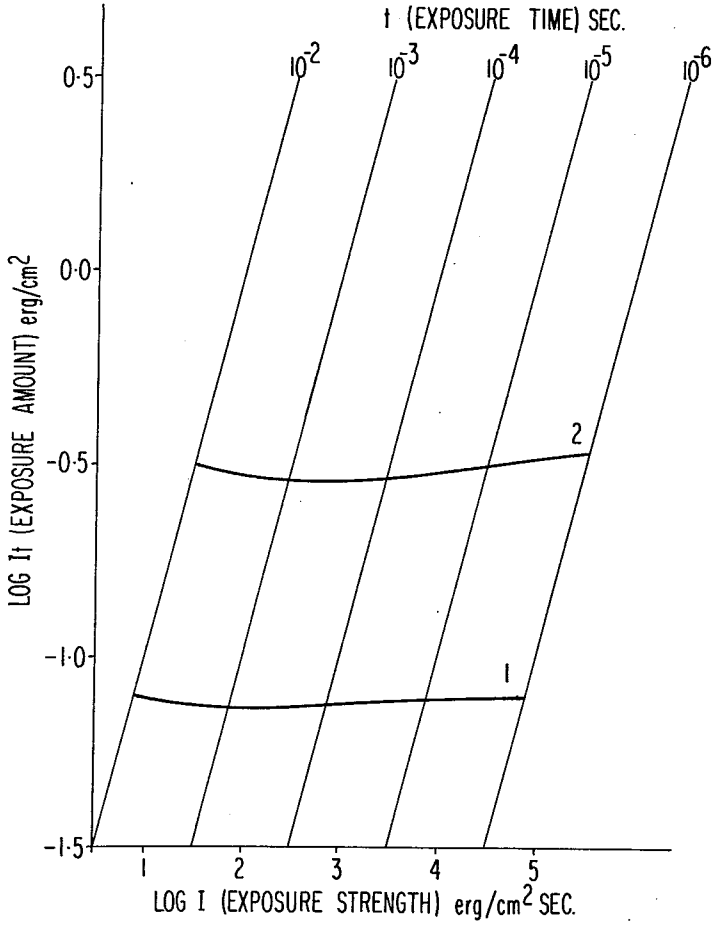
Figure 6:
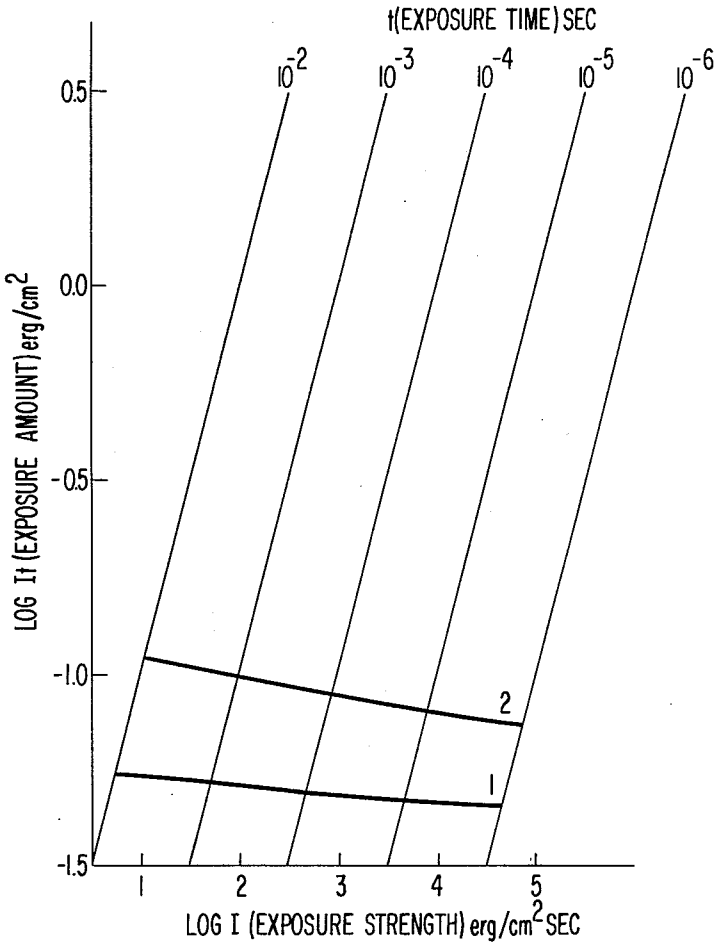
Figure 5:
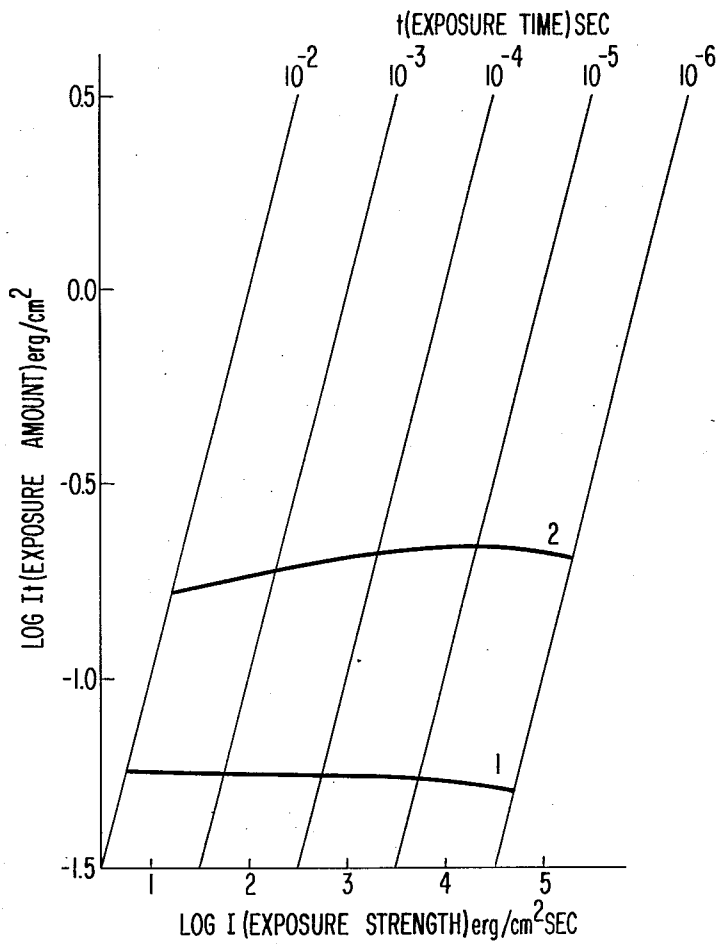

| No. | Dye | Amount added ml | Wavelength of light used to measure (nm) | Relative sensitivity $10^{-2}$sec. | Relative sensitivity $2\times10^{-6}$sec. | Ratio (A) | Reciprocity law curve |
|---|---|---|---|---|---|---|---|
| 1 | None | (original emulsion) | 381 | 186 | 135 | 0.72 | FIG. 1 curve 1 |
| | " | | 494 | 19 | 9.3 | 0.49 | FIG. 1 curve 2 |
| 2 | D | 60 | 381 | 87 | 66 | 0.76 | FIG. 2 curve 1 |
| | " | " | 494 | 11 | 6.0 | 0.54 | FIG. 2 curve 2 |
| | " | " | 521 | 27 | 20 | 0.74 | FIG. 2 curve 3 |
| 3 | IA | 40 | 381 | 126 | 135 | 1.07 | FIG. 3 curve 1 |
| | " | " | 494 | 32 | 30 | 0.94 | FIG. 3 curve 2 |
| 3 | IA | 80 | 381 | 112 | 145 | 1.30 | FIG. 4 curve 1 |
| " | " | " | 494 | 56 | 65 | 1.16 | FIG. 4 curve 2 |
| 4 | IB | 40 | 381 | 178 | 200 | 1.12 | FIG. 5 curve 1 |
| " | " | " | 494 | 63 | 50 | 0.80 | FIG. 5 curve 2 |
| " | " | 80 | 381 | 200 | 222 | 1.11 | FIG. 6 curve 1 |
| " | " | " | 494 | 100 | 138 | 1.38 | FIG. 6 curve 2 |
| 5 | IJ | 80 | 381 | 100 | 141 | 1.41 | |
| " | " | " | 494 | 23 | 19 | 0.83 | |

The ratio (A) as used in the Examples is the value defined as follows:

$$\left[\frac{\text{Relative sensitivity obtained by the exposure for } 2\times10^{-6}\text{sec.}}{\text{Relative sensitivity obtained by the exposure for } 1\times10^{-2}\text{sec.}}\right]$$

From Run No.3, it can be seen that dye (IA) provides a spectral sensitization (in this case, in the exposure with 494 nm monochromatic light of a narrow band width) having an extremely small reciprocity law failure at high illuminace as compared with that of dye (D)(Run No. 2). In addition, from a comparison with the no additive Run (Run No.1), it can be seen that for dye (IA) the reciprocity law failure at high intensity in the exposure by light in the wave-length region of intrinsic sensitivity (in this case, to 381 nm monochlomatic light having a narrow band width) is improved. From Run No. 4 it can be seen that dye (IB) provides an high intrinsic sensitivity and spectral sensitivity at exposure for $2 \times 10^{-6}$ seconds.

The detailed effects of the dyes of the present invention on the reciprocity law failure of the silver halide emulsion are most well shown in FIGS. 2 – 6.

EXAMPLE 2

The same silver halide chlorobromide emulsion as was used in Example 1 was employed. 250 Grams of water was added to 250 g of the emulsion. The emulsion was melted and stored at 40°C. The sensitizing dyes listed in Table 2 and the same addition compounds as in Example 1 were added thereto in the same manner as in Example 1 to thereby obtain the samples.

The exposure was conducted for $1 \times 10^{-5}$ second using a xenon flash sensitomer. The spectrogram was obtained by exposing for 1/50 second using a reflection grating-type spectrograph made by NARUMI Trading Company.

For the purpose of testing the stability of each sample under the conditions of high temperature and high humidity, each sample was incubated for 48 hours at a temperature of 50°C ± 2°C and at a relative humidity of 80% ± 5%. The results obtained are given in Table 2.

From the results given in Table 2, it can be seen that though dyes (A) and (B) provide high sensitivity, they cause desensitization upon storage under conditions of high temperature and high humidity and that though dyes (C) and (E) spectrally sensitize the blue-green light wave-length region, they provide only a low sensitivity in the flash exposure. In addition, it can easily be understood that the dyes in accordance with the present invention can maintain high sensitivity in the blue-green light wave-length region, i.e., the blue region and the relatively short wave length (near blue) region of green even when they are stored at high temperature and high humidity.

Table 2

Figure 7:
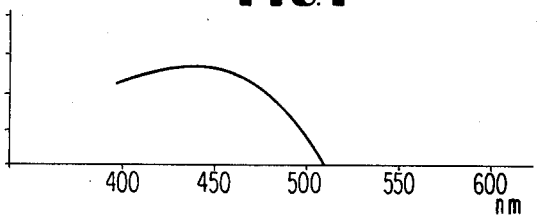
FIGS. 7 – 19 show comparative spectrograms of various systems described in the Examples.
Figure 8:
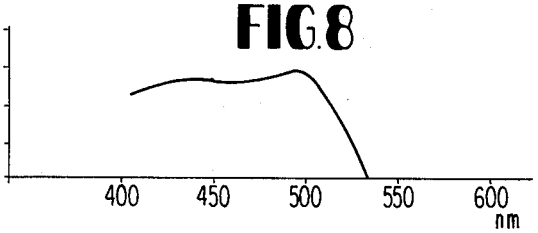
Figure 9:
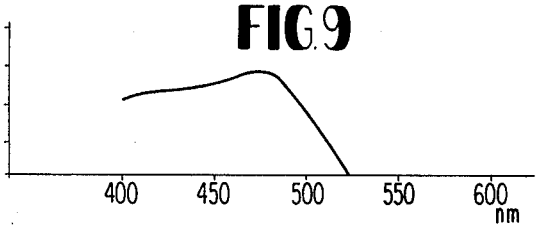
Figure 10:
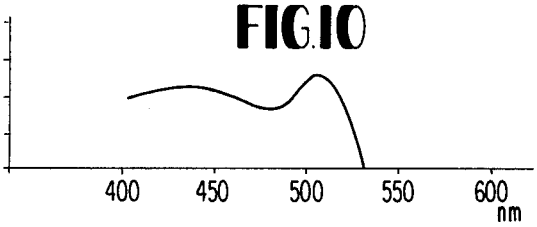
Figure 11:
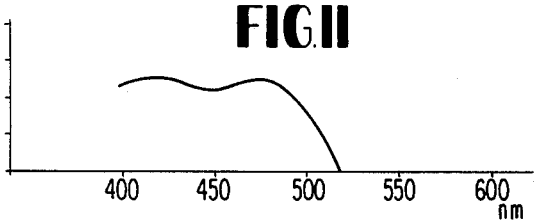
Figure 12:
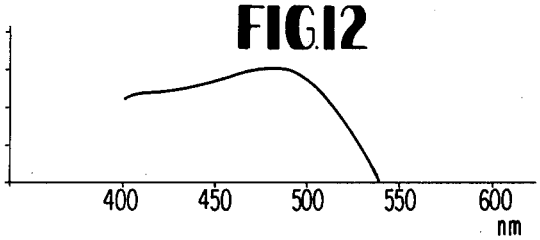
Figure 13:
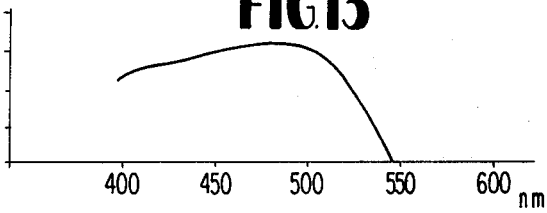
Figure 14:
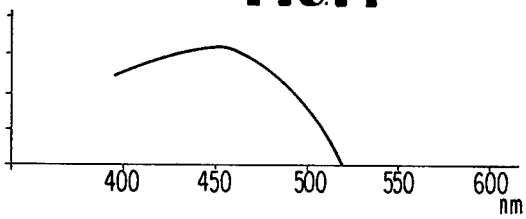
Figure 15:
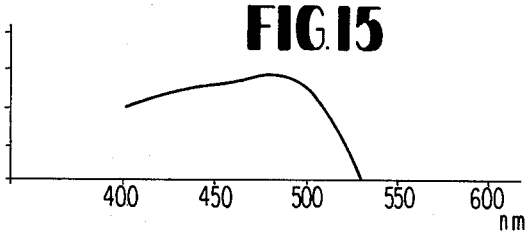
Figure 16:
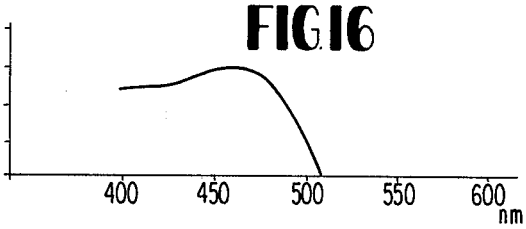

| No. | Dye | Amount added (ml) ($2 \times 10^{-3}$ mols per l) | Fresh sample: Relative sensitivity | Fresh sample: Fog | Incubated sample: Relative sensitivity | Incubated sample: Fog | Spectogram |
|---|---|---|---|---|---|---|---|
| 6 | None | (original emulsion) | 100 | 0.04 | 90 | 0.05 | FIG. 7 |
| 7 | (A) | 30 | 112 | 0.05 | 89 | 0.06 | FIG. 8 |
| | " | 60 | 132 | 0.05 | 85 | 0.07 | |
| | " | 80 | 126 | 0.11 | 50 | 0.26 | |
| 8 | (B) | 30 | 110 | 0.04 | 72 | 0.07 | FIG. 9 |
| | " | 60 | 136 | 0.04 | 53 | 0.07 | |
| | " | 80 | 112 | 0.07 | 25 | 0.12 | |
| 9 | (C) | 30 | 70 | 0.04 | 81 | 0.05 | FIG. 10 |
| | " | 60 | 76 | 0.04 | 81 | 0.05 | |
| | " | 80 | 56 | 0.06 | 75 | 0.10 | |
| 10 | (E) | 30 | 90 | 0.06 | 62 | 0.07 | FIG. 11 |
| | " | 60 | 100 | 0.06 | 100 | 0.07 | |
| | " | 80 | 63 | 0.11 | 63 | 0.11 | |
| 11 | (IA) | 30 | 132 | 0.04 | 130 | 0.05 | FIG. 12 |
| | " | 60 | 148 | 0.04 | 141 | 0.05 | |
| | " | 80 | 135 | 0.15 | 126 | 0.18 | |
| 12 | (IB) | 20 | 142 | 0.05 | 138 | 0.05 | FIG. 13 |
| | " | 40 | 158 | 0.05 | 160 | 0.07 | |
| | " | 60 | 150 | 0.07 | 150 | 0.07 | |
| 13 | (F) | 20 | 135 | 0.06 | 126 | 0.06 | FIG. 14 |
| | " | 40 | 126 | 0.07 | 121 | 0.10 | |
| 14 | (G) | 40 | 126 | 0.04 | 126 | 0.05 | FIG. 15 |
| | " | 60 | 135 | 0.05 | 135 | 0.07 | |
| 15 | (H) | 40 | 112 | 0.04 | 120 | 0.04 | FIG. 16 |
| | " | 60 | 125 | 0.04 | 132 | 0.05 | |

EXAMPLE 3

A gelatino silver chlorobromide emulsion was prepared according to a conventional double jet method. The halogen composition of the resulting grains was 85 mole% $Br^-$ ion. 1.5 cc of a 1/100,000 part (by weight) solution of rhodium (III) chloride and 4.3 cc of a 1/10,000,000 part (by weight) solution of mercury (II) rhodanate were incorporated therein per 1 milimol of silver ion during a silver halide-forming step. The resulting silver chlorobromide emulsion was gold sensitized with 2.7 cc of a 10% gold (III) chloride solution per 1 mole of silver ion, and sulfur sensitized by sodium thiosulphate in a conventional manner. The mode size of the grains was 0.7 micron. The emulsion thus obtained contained about 1.2 moles of silver ion per 1 kg of the emulsion.

300 g of water was added to 700 g of the thus obtained silver chlorobromide original emulsion to make the total 1 kg. The resulting mixture was melted at 50°C and, while maintaining the mixture of 40°C, a methanol solution of each of the sensitizing dyes listed in Table 4 each containing $5 \times 10^{-3}$ moles of the sensitizing dye listed per 1. was each added thereto with stirring. Furthermore, 20 cc of a 2% aqueous solution of 2,4-dichloro-6-hydroxy-*S*-triazine and 10 cc of a 1% aqueous solution of sodium nonylbenzylsulfonate were added thereto, and the resulting mixture was applied to a cellulose triacetate film in a dry thickness of about 4 microns.

The resulting samples were cut into strips and subjected to sensitometry. The sensitometer used was a flash sensitometer (made by E.G.G. Co.) wherein the flash time was set to the time in second given in Table 4. Monochromatic light was obtained using an interference filter, and the exposure amount thereof was determined employing physical photometry with an actinometer and photographic photometry in combination.

The exposed strips were developed at 20°C for 3 minutes using the following developer, fixed, washed and dried. The density of the thus treated strips was measured using an S type densitometer made by Fuji Photo Film Co., Ltd. to obtain a photographic characteristic curve.

The exposure amount necessary to provide an optical density of (fog + 1.0) was detemined, and the sensitizing effect of the dye was indicated by the reciprocal of the exposure amount thus determined (which is defined as the relative sensitivity). Composition of the developer used:

| | | |
|---|---|---|
| Water | 500 | ml |
| Metol | 2 | g |
| Anhydrous sodium sulfite | 90 | g |
| Hydroquinone | 8 | g |
| Sodium carbonate monohydrate | 52.5 | g |
| Potassium bromide | 5 | g |
| Water to make | 1000 | ml |

The results obtained are shown in Table 4

Table 4

Figure 17:
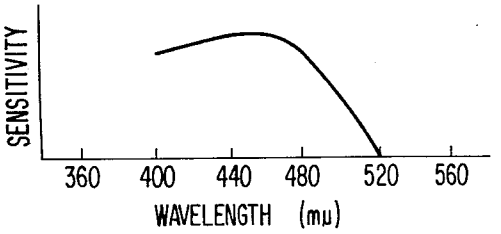
Figure 18:
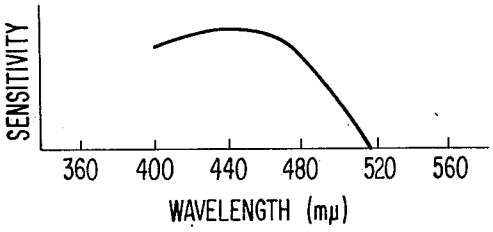

| No. | Dye | Amount added (ml) | Wave-length for measurement (nm) | Relative sensitivity $10^{-2}$sec. | Relative sensitivity $2\times10^{-6}$sec. | Ratio (A) | Spectrogram |
|---|---|---|---|---|---|---|---|
| 1 | (IK) | 40 | 381 | 192 | 200 | 1.04 | FIG. 17 |
| | | | 445 | 230 | 250 | 1.09 | |
| | | 80 | 381 | 190 | 200 | 1.05 | |
| | | | 455 | 230 | 262 | 1.14 | |
| 2 | (IL) | 80 | 381 | 186 | 192 | 1.03 | FIG. 18 |
| | | | 455 | 200 | 222 | 1.11 | |

Figure 19:
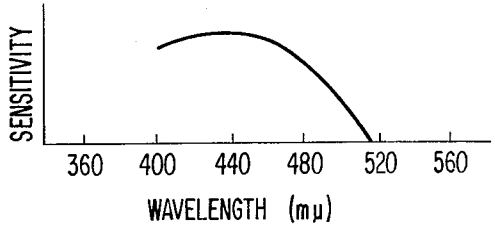

FIGS. 17–19 are spectrograms, wherein FIGS. 17 and 18 are spectrograms in the case of adding to an emulsion dyes (IK) (80 ml) and (IL) (80 ml), respectively, and FIG. 19 is a spectrogram of the original emulsion formed above, that is, an emulsion formed as described but for the lack of sensitizing dye (IK) or (IL).

The sensitizing dyes to be used in the invention have the advantage of reducing the reciprocity law failure at high intensity.

The light-sensitive material obtained by the present invention is particularly useful for recording by flash exposure. The effects thereof are not lost with any of the commonly used developments such as a Metol-hydroquinone development, pyrazonehydroquinone development, p-phenylenediamine development or an infectious development.

While the invention has been described in detail and with reference to specific embodiments thereof, it will be apparent to one skilled in the art that various changes and modifications can be made therein without departing from the spirit and scope thereof.

What is claimed is

1. A silver halide photographic emulsion having high sensitivity to flash exposure, consisting essentially of grains of silver halide selected from the group consisting of silver chlorobromide and chlorobromoiodide, the grain size ranging from about 0.04 to about 1 micron, said grains being chemically sensitized with a combination of a gold salt and at least one of the group VIII metal salts or a combination of a gold salt and at least one of the group II metal salts, a protective colloid, and a sensitizing amount of a simple merocyanine dye having the following formula (II),

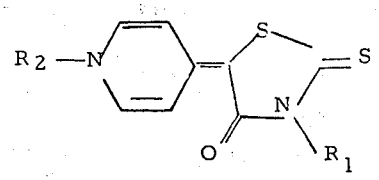

(II)

wherein $R_1$ and $R_2$ represent an unsubstituted alkyl group, allyl group, sulfoalkyl group or carboxyalkyl group, said sensitizing dye being the only sensitizing dye present in the emulsion.

2. A silver halide photographic emulsion as claimed in claim 1, wherein the mode size of the silver halide grains contained therein is from 0.8 micron to 0.04 micron.

3. A silver halide photographic emulsion as claimed in claim 1, wherein the maximum sensitivity wavelength of the emulsion is in the region shorter than 520m$\mu$.

4. The emulsion of claim 1 wherein the silver halide is silver chlorobromide.

* * * * *